United States Patent [19]

Bloomfield

[11] 4,061,190

[45] Dec. 6, 1977

[54] IN-SITU LASER RETORTING OF OIL SHALE

[75] Inventor: Harvey S. Bloomfield, Bay Village, Ohio

[73] Assignee: The United States of America as represented by the United States National Aeronautics and Space Administration, Washington, D.C.

[21] Appl. No.: 763,753

[22] Filed: Jan. 28, 1977

[51] Int. Cl.[2] ..... E21B 43/24

[52] U.S. Cl. ..... 166/259; 166/248

[58] Field of Search ..... 166/248, 256, 259; 208/11 R; 175/11, 16, 17

[56] References Cited

U.S. PATENT DOCUMENTS

| | | | |
|---|---|---|---|
| 3,400,762 | 9/1968 | Peacock et al. | 166/259 |
| 3,411,575 | 11/1968 | Connally, Jr. | 166/259 |
| 3,493,060 | 2/1970 | Van Dyke | 175/16 |
| 3,652,447 | 3/1972 | Yant | 208/11 R |
| 3,696,866 | 10/1972 | Dryden | 166/248 |
| 3,977,478 | 8/1976 | Shuck | 166/308 |
| 4,019,577 | 4/1977 | Fitch et al. | 166/259 |

*Primary Examiner*—James A. Leppink

*Attorney, Agent, or Firm*—N. T. Musial; J. A. Mackin; John R. Manning

[57] ABSTRACT

Oil shale formations are retorted in-situ and gaseous hydrocarbon products recovered by drilling two or more wells into an oil shale formation underneath the surface of the ground; fracturing a region of said oil shale formation by directing a high energy laser beam into one of said wells and focussing said laser beam onto said region of said oil shale formation from a laser optical system; forcing a compressed gas into said well through which said laser beam was directed at the site of said fracture which supports combustion in the flame front ignited by said laser beam in the fractured region of said oil shale, thereby retorting said oil shale; and recovering gaseous hydrocarbon products which permeate through said fractured oil shale from one of said wells through which the laser beam was not directed.

8 Claims, 1 Drawing Figure

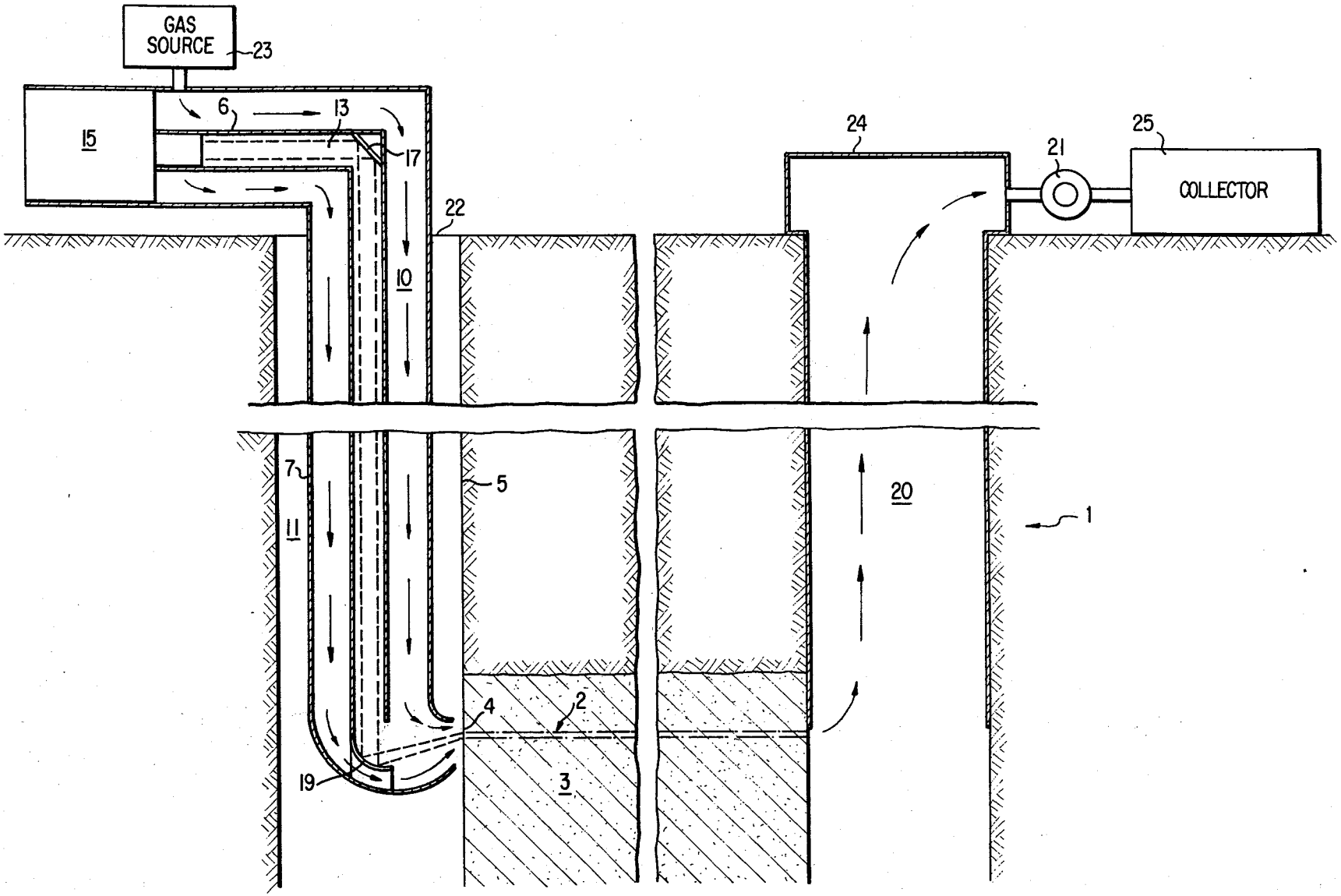
COLLECTOR
GAS SOURCE
1
2
3
4
5
6
7
10
11
13
15
17
19
20
21
22
23
24
25

IN-SITU LASER RETORTING OF OIL SHALE

ORIGIN OF THE INVENTION

The invention described herewin was made by an employee of the United States Government and may be manufactured and used by or for the Government of the United States of America for governmental purposes without the payment of any royalties thereon or therefor.

BACKGROUND OF THE INVENTION

1. Field of the Invention

The present invention relates to a method for retorting and obtaining hydrocarbons from underground shale deposits. More particulary, the present invention relates to a process for the in-situ laser retorting of hydrocarbons from underground shale deposits.

2. Description of the Prior Art

In the past many methods have been devised for the processing of fossil fuels to recover hydrocarbons values therefrom. One such method as described in U.S. Pat. No. 3,652,447 involves first mining oil shale and placing the oil shale, which is crushed, into an enclosure. A pulsed laser beam is used to heat the bottom layers of the oil shale in the enclosure, and air is drawn into the bed of shale to cause eduction of gaseous hydrocarbons upwardly through the shale into a gas collection space. The rising air and gas heat the upper layers of the bed of shale thereby retorting the entire body of shale. Gaseous products are then withdrawn from the base of the enclosure. While this method is applicable to the retorting of previously mined or recovered oil shale, it cannot be used for the in-situ retorting of oil shale.

Methods have been developed in the past for the in-situ recovery and retorting of underground deposits of oil shale. All of these methods share the following basic steps in which a predetermined pattern of wells is drilled in the oil shale formation, and the formation is fractured to increase the permeability of the shale. Thereafter the shale is ignited at one or more centrally locoated wells. After ignition, compressed air is pumped down into the ignition wells to support combustion processes within the shale formation, and the hot combustion gases are forced through the fractured shale to degrade the solid organic material within the shale to an oil product. The oil produced by the thermolytic degradation process is subsequently recovered through other wells. All of these techniques share the common problems of attaining the desired degree of permeability of the shale within the formation by fracturing the oil shale between previously drilled wells, and of underground ignition and heating of the shale.

In the past, a number of methods have been employed to create a permeable shale bed which include hydraulic fracturing, electrolinking, electropneumatic and electrochemical fracturing and fracturing using conventional explosives. Other techniques have used combinations of these methods of fracturing oil shale. Thus far, it has been necessary to recover the fractured shale in order to simulate in-situ processing in above ground retorts by utilizing natural gas for ignition and recycled gas and air injection to support combustion within the shale bed. Alternatively, as shown in U.S. Pat. No. 3,652,447, a laser beam can be employed to ignite the combustion process.

One method has been developed for the in-situ retorting of shale deposits as disclosed in U.S. Pat. No. 3,696,866. In this method two wellbores are drilled into a shale deposit and an electrode is lowered into each of the wells at a position in the shale bed. A high d.c. voltage is then impressed across the electrodes, which results in the formation of a conducting core in the shale deposit. One of the electrodes is removed from one of the wells, and is replaced by an electrolyte solution to a level above the core and an acid resistant electrode. A high d.c. voltage is then impressed across the pair of electrodes which causes electrolysis and results in the formation of free oxygen where the conducting core intersects the solution. With sufficient voltage, intense heating and arcing occurs in the core of the shale thus resulting in combustion of organic materials. Application of the voltage is continued until the combustion zone has completely penetrated the path between the wellbores. This method has the disadvantage of requiring the use of a high voltage source and of the necessity of having to place an aqueous electrolyte into one of the well bores. Moreover, and acid resistant electrode must be used in the electrolyte solution. Accordingly, a need continues to exist for a simpler method for conducting the in-situ retorting of shale deposits for the eventual recovery of hydrocarbon products.

SUMMARY OF THE INVENTION

Accordingly, one object of the present invention is to provide a method for fracturing underground oil shale formations to render the shale permeable such that the in-situ retorting of the shale can be performed to effect recovery of hydrocarbon products from the shale.

Briefly, this object and other objects of the present invention as hereinafter will become more readily apparent can be attained in in a method for the in-situ retortingof oil shale and recovery of gaseous hydrocarbon products by drilling two or more wellbores into an oil shale formation underneath the surface of the ground; fracturing a region of said oil shale formation by directing a high energy laser beam into one of said wells and focussing said laser beam onto said region of said oil shale formation from a laser optical system; forcing a compressed gas into said well through which said laser beam was directed at the site of said fracture which supports combustion in the flame front ingnited by said laser beam in the fractured region of said oil shale, thereby retorting said oil shale; and recovering gaseous hydrocarbon products which permeate through said fractured oil shale from one of said wells through which the laser beam was not directed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings; wherein:

The FIGURE shows an embodiment of the invention in which an oil shale formation is fractured by use of a laser beam and in-situ retorting of the fractured shale is conducted.

DETAILED DESCRIPTION OF THE PREFERRED EMBODIMENTS

The essential and important feature of the present invention is the use of a high energy laser beam which is directed into an oil shale formation to simultaneously cause fracturing of the shale, thereby inducing permeability of the underground formation and ignition of the shale within the underground formation. A compressed gas such as air, which supports combustion, is passed down into the well at the site of the fracture to force a flame front ignited by the laser through the fracture. Gaseous hydrocarbon products are produced by the retorting of the shale and are withdrawn from other associated wells which are coupled to the well through which the laser beam is directed as they permeate through the fracture zone. The type of laser apparatus employedin the present method is not critical, and any device which emits a beam of sufficient energy to cause fracturing and ignition of the shale can be employed. A typical laser is a high power (multiKilowatt average power) infrared $CO_2$ laser device. Both pulsed and continuous infrared lasers can be used.

Reference is now made to the FIGURE, which shows an embodiment of the present method, to achieve a more completed understanding of the invention. The FIGURE shows a vertical cross-section of ground 1 containing an underlying oil shale formation 3. A wellbore 5 is drilled into the ground 1 which penetrates into the underlying shale deposit 3, and is provided with two ducts 6 and 7. Central duct 6 functions as a protective housing for a laser beam 13, a beam turning mirror 17, and a beam focussing mirror 19. Outer duct 7 provides a housing for annular region 10. If housing 7 is smaller in diameter than well 5, an annular region 11 is established by annular wall 22. In the FIGURE the well 5 is shown as directed vertically downward through a shale deposit. However, such a well could also be directed horizontally through a shale deposit such as through the face of a cliff. It is not critical or necessary that either duct 6 or 7 be located concentrically within well 5. The diameter of well 5 is not critical, although the diameter of central duct 6 should be greater than ten times the beam diameter. The depth of well 5 is only dependent upon the depth of the shale deposit or how far into the shale deposit the laser beam is to be directed.

At least one wellbore 20 is drilled into the shale deposit for the eventual recovery of gaseous hydrocarbon products which permeate through fracture zone 2 from wellbore 5 to wellbore 20.

The central duct 6 provides the channel by which the laser beam can be directed down into the wellbore and focussed onto the desired portion of the oil shale formation. Thus, laser beam 13 from laser 15 is reflected by beam turning mirror 17 down into the central duct 6 of the wellbore. However, beam turning mirror 17 can be eliminated by placing the laser in a vertical position above the central core, thereby directing the beam directly down the central core of the well. The beam is then reflected at the desired fracture point 4 in the shale formation 3 by a focussing mirror 19 which directs the focussed laser beam to a spot in the oil shale formation. It is important that the laser beam strike the side of the wellbore 5 at an angle so that the slag generated in the fracture can flow from the fractured zone. The oil shale is rapidly heated by the focussed beam to high temperatures by the action of the focussed beam which causes fracturing of the region 2 of the shale formation which initiates combustion in the oil shale formation. The focussing mirror is placed at the desired level in the well and fixedly attached to duct 7. The reflecting and focussing mirrors are fabricated from uncooled, low absorption reflecting materials which are compatible with the high flux beams used. The only important consideration is that the mirrors be capable of withstanding high flux densities. The laser beam which is reflected from the focussing mirror into the shale deposit is focussed to an extent which is a function of the depth of the well and the original beam flux density. The beam is directed into the shale deposit for a time sufficient to cause fracturing and ignition of a layer of shale.

The first annular region 10 functions as a means for conducting a pressurized gas into the oil shale formation. The gas in addition to supporting combustion and functioning as a carrier gas for heated shale oil effluent, also functions to cool and clean the last focussing mirror 19. The gas must be capable of supporting combustion and therefore is an oxygen containing gas such as air or oxygen. The gas should be relatively dry, i.e., low water content. The gas could possibly contain a combustible component such as methane to aid in the combustion process, although such a combustible component raises problems because of the possibility of an explosion. The gas is injected into the well 5 under a pressure sufficient to maintain combustion in the shale zone from a suitable gas source 23. The flow of pressurized gas is continued only as long as the continuation of combustion is desired.

The focussed laser beam gnerates a hole in the shale formation whose horizontal depth within the shale is increased until the stress gradient on the shale exceeds the strength of the shale. When this point is reached, the shale fractures preferentially parallel to the bedding plane. The introduction of the pressurized gas at the point of the shale fracture 4 supports a flame front which can move through the fractured zone in the shale formation. The laser beam is turned off when the fracture extends between the wellbores.

The gaseous hydrocarbon product which is evolved by the retorting of the shale zone, permeates through the fractured shale and is withdrawn through an adjacent well 20 closed by a cover 24 and is collected in a suitable collector 25 and processed for further use. A vacuum pump 21 can be employed to facilitate removal and collection of the evolved gases from an adjacent well 20 and to direct the flame front selectivity to the adjacent well 20. Since the gaseous hydrocarbon product is a complex mixture of materials, the manner in which the gas is subsequently processed is dependent on what types or blends of hydrocarbon products and hydrocarbon containing gases are desired. The liquid hydrocarbon products produced in the process are not recovered and are allowed to remain in the well.

Having now fully described the invention, it will be apparent to one of ordinary skill in the art that many changes and modifications can be made thereto without departing from the spirit or scope of the invention as set forth herein.

What is desired as new and intended to be secured by letters patent is:

1. A method for the in-situ retorting of oil shale and recovery of gaseous hydrocarbon products, which comprises:

drilling at least two wellbores into an oil shale formation underneath the surface of the ground;

fracturing a region of said oil shale formation by directing a high energy laser beam into one of said wells and focussing said laser beam onto said region of said oil shale formation from a laser optical system;

forcing a compressed gas into said well through which said laser beam was directed to the site of said fracture which supports combustion in the flame front ignited by said laser beam in the fractured region of said oil shale, thereby retorting said oil shale; and recovering gaseous hydrocarbon products which permeate through said fractured oil shale into the bore of a well adjacent the well through which said laser beam is directed.

2. The method of claim 1, wherein said well is provided with a housing in which is vertically disposed a central duct having a central core and which provides an annular region between said housing and said central duct and an annular region between said housing and said well.

3. The method of claim 2, wherein said laser beam is reflected by a mirror into said central duct such that it traverses said central duct until it strikes a focussing mirror located within said central duct at a region within said shale formation which focusses said beam on said region of said formation, and wherein said focussed beam ignites and fractures said region of said oil formation.

4. The method of claim 2, wherein a compressed gas is forced into said annular region between said housing and said duct which gas supports combustion and forces said flame front and gaseous products through said fractured region and which simultaneously functions to clean and focussing mirror.

5. The method of claim 1, wherein said compressed gas is air or oxygen.

6. The method of claim 1, wherein said compressed gas is forced into said central core at a pressure sufficient to support combustion.

7. The method of claim 2, wherein said gaseous hydrocarbon products are recovered.

8. The method of claim 7, wherein said gaseous hydrocarbon products are recovered by vacuum recovery through an adjacent well.

* * * * *